United States Patent [19]

Rajner et al.

[11] Patent Number: 5,070,658

[45] Date of Patent: Dec. 10, 1991

[54] CERAMIC ARTICLES, AND A PROCESS FOR THE PRODUCTION THEREOF

[75] Inventors: Walter Rajner, Nürenberg; Klaus Russner, Lauf, both of Fed. Rep. of Germany

[73] Assignee: Hoechst CeramTec Aktiengesellschaft, Selb, Fed. Rep. of Germany

[21] Appl. No.: 411,500

[22] PCT Filed: Mar. 30, 1988

[86] PCT No.: PCT/EP88/00263

§ 371 Date: Oct. 6, 1989

§ 102(e) Date: Oct. 6, 1989

[87] PCT Pub. No.: WO88/07913

PCT Pub. Date: Oct. 20, 1988

[30] Foreign Application Priority Data

Apr. 7, 1987 [DE] Fed. Rep. of Germany ..... 3711749

[51] Int. Cl.[5] ..... B24B 1/00

[52] U.S. Cl. ..... 51/316; 51/163.1; 51/164.1

[58] Field of Search ..... 51/316, 313, 16, 17, 51/26, 163.1, 163.2, 164.1, 164.2; 251/368; 137/375, 625.17, 625.4, 625.41

[56] References Cited

U.S. PATENT DOCUMENTS

| | | | |
|---|---|---|---|
| 3,745,722 | 7/1973 | Balz | 51/314 |
| 3,965,620 | 6/1976 | Dreher | 51/164.1 |
| 4,420,142 | 12/1983 | Dworak et al. | 251/368 |

FOREIGN PATENT DOCUMENTS

| | | |
|---|---|---|
| 1291957 | 11/1969 | Fed. Rep. of Germany . |
| 58-192745 | 11/1983 | Japan . |
| 60-177864 | 9/1985 | Japan . |

OTHER PUBLICATIONS

A. Linek, "Trommeln", Deutscher Fachzeitschriften- und Fachbuchverlag GmbH, VDI-Berichte Nr. 194, 1973, pp. 124–125.

M. Dreher, "Die Gleitschlifftechnik in Trommeln und Fliehkraftgeraeten", Metalloberfglaeche, vol. 41, No. 3, Mar. 1987, pp. 105–108.

*Primary Examiner*—Martha Rachuba

*Attorney, Agent, or Firm*—Foley & Lardner

[57] ABSTRACT

A ceramic sealing component for a machine whch is in frictional contact and has at least one non-reflective sliding and sealing face of a mean roughness (Ra) greater than 0.1 and a minimum of 0.8 μm is described. A component of this type can be produced by subjecting a green ceramic article to shaping, sintering, processing by face-grinding or round-grounding, optionally washing and then abrasive-polishing in the presence of an aqueous phase until the mean roughness desired for the machine component is reached.

35 Claims, No Drawings

CERAMIC ARTICLES, AND A PROCESS FOR THE PRODUCTION THEREOF

The invention relates to a process for the production of ceramic components which have at least one planar or curved sliding and sealing face.

Ceramic objects having a planar or curved sliding and sealing face are usually produced by shaping a green ceramic article, sintering, grinding and subsequent lapping or polishing the ground face. Sliding rings for gaskets or sealing and regulating washers for sanitary fittings are examples of objects produced in this way. During polishing, the moldings are treated for a relatively long period with a paste or emulsion of a polishing agent, for example diamond grit, and at the same time pressed against rotating surfaces, for example grooved planar steel disks, in special-purpose automatic polishers. Rough areas are leveled in this way. Machines for lapping and polishing require high investment; their operation is labor-intensive and therefore associated with high labor costs per unit.

For aluminum oxide sliding rings, a maximum permissible unevenness of 0.6 μm is required for adequate sealing. The mean roughness (Ra) should not exceed 0.15 μm (VDI Reports (sic) No. 194, 1973, p. 124). Such roughnesses can only be achieved by polishing or lapping.

European Offenlegungsschrift 043,456 discloses valve washers for mixing valves, in particular sanitary mixing faucets, which contain zirconium oxide or hafnium oxide and have a mean roughness of less than 0.3 μm. Treatment by lapping or polishing is necessary for the production of these washers.

In the visual control of customary ceramic articles having a sliding and sealing face, those skilled in the art require that this face reflects.

The object was therefore to specify a process for the production of ceramic moldings which have planar or curved sliding and sealing surfaces, and with the aid of which it is possible to produce in a simple and inexpensive manner, surfaces of identical sliding and sealing behavior.

The present process achieves this object. This is a process for the production of ceramic sealing components for a machine, the components being in frictional contact and having at least one planar or curved sliding and sealing face, by shaping a green ceramic article, sintering, grinding and subsequently smoothing the sliding and sealing face formed and, if necessary, subsequently washing. This process comprises abrasive-polishing the articles in the presence of an aqueous phase, without using scouring elements, until a mean roughness of greater than 0.1 and not more than 0.8 μm is reached, the articles used being shaped in such a way that they can develop their abrasive-polishing effect on the sliding and sealing face being formed.

In abrasive polishing, small parts, which are usually present in large numbers, are agitated in a container, together with an aqueous phase, for a relatively long period. This process is used for deburring or polishing metallic parts in electroplating.

This process is described in greater detail in the reference book "Trommeln" by A. Linek, Deutscher Fachzeit-schriften- und Fachbuchverlag GmbH, Stuttgart, 1953. It is stated that the metallic parts are agitated in the presence of added abrasive elements, for example sand or "Trowal" (synthetically prepared aluminum oxide). The treatment of ceramic surfaces is not mentioned in this literature citation.

The process according to the invention can be applied, in particular, to the smoothing of the surfaces of articles made from silicon carbide, steatite and aluminum oxide.

After grinding, the mean roughness Ra is 0.8 to more than 1 μm, depending on the abrasive disk used. It is possible, but in most cases not necessary, to wash and thus to free of grinding dust, the ground ceramic articles before abrasive polishing. Washing or degreasing is appropriate, in particular, if the ceramic articles are contaminated by grinding oil. In this refinement of the process according to the invention, finely divided abrasive substances, such as sand, are not present. In the case of planar sliding faces, the grinding takes place by face grinding, and in the case of curved faces by circular grinding.

Abrasive polishing takes place in a scouring apparatus. Scouring drums, for example, in which the ceramic articles undergo tumbling movements similar to in a washing machine can be employed. This is favorable if, in addition to the smoothing of the sliding and sealing face, rounding of the edges is desired. Furthermore, scouring vibrators, in which the articles undergo short oscillating movements of high frequency can be employed. In these vibrators, relatively large parts, in particular, can be treated without danger of damage. The scouring apparatus is usually filled to 10 to 90% by volume, preferably 30 to 60% by volume, with the ceramic articles which are to be polished by abrasion. Some of the volume of the apparatus, for example 0 to 30%, in particular 0 to 10% by volume, can remain empty. The remainder is filled with aqueous phase. The amount of water should be at least large enough so that all ceramic parts are covered with water, even during the scouring process. The correct degree of filling can be determined by simple experiments and is usually in the range 15–45% by volume. The scouring time is several hours, for example 5–40 hours, and depends somewhat on the adjustable agitation intensity. Scouring sieves are also suitable, even if the necessary time is longer than in the case of vibrators. Measured from the mean roughness, the smoothing process proceeds rapidly at the beginning and more slowly later, so that there is hardly any danger of obtaining abrasive-polished articles having an undesirably low roughness.

If the amount of ceramic articles in the scouring machine is low, too few abrasion partners are present; in this case, the smoothing effect is not ideal and the possibility of fracture exists due to the vigorous tumbling. If the amount of ceramic articles is too great, the relative motion between the parts is insignificant, which leads to excessively long processing times.

The process according to the invention is suitable, in particular, for the production of sealing and regulating washers (for sanitary application), sliding rings, plungers, shafts, protective sleeves for shafts, bearing rings and balls for ball valves.

It has been shown that a particularly smooth surface is obtained if a surfactant, for example, soft soap, is added to the treatment liquid in amounts of 0.05–20 g/l, preferably 0.1 to 10 g/l. In this way, the formation of scratches is suppressed and the speed of the smoothing process is increased.

There are ceramic moldings in which the sliding face or sealing face faces inwards or, at least, is in such an unfavorable position that the elements are to that extent unable to develop a mutual abrasive-polishing action. This applies, for example, to certain protective sleeves for shafts, bearing rings and to combined sliding and bearing rings. In these, the sliding and sealing faces are in the interior. In this case, it is necessary to work in the presence of small scouring elements which are free of sharp edges and which are able to reach the faces to be scoured The invention furthermore relates to a process for the production of a ceramic sealing component for a machine, the component being in frictional contact and having at least one planar or curved sliding and sealing face, by shaping a green ceramic article, sintering, grinding and subsequently smoothing the sliding and sealing face formed, which process comprises abrasive-polishing the article in the presence of an aqueous phase with the addition of scouring elements, but in the absence of finely divided abrasively acting substances until a mean roughness of greater than 0.1 and not more than 0.8 μm is reached.

Examples of scouring elements which can be used are spheres or rods of ceramic material, for example spheres whose diameter, and rods whose length, is 3–10 mm. Scouring elements having a density of 2 to 4g/ml, preferably scouring elements of the same composition as the ceramic article to be smoothed, are preferred. The scouring elements can comprise $Al_2O_3$, SiC or boron carbide. If working in the presence of scouring elements, the scouring machine should be full to 10–90% by volume, in particular 40–75% by Volume, With the ceramic articles to be smoothed, plus the scouring elements. The scouring elements : ceramic articles to be smoothed weight ratio may be 0:1 to 5:1, in particular 1:1 to 3:1. A further excess of scouring elements is not harmful, but only uneconomic. The use of scouring elements is also appropriate if the sliding and sealing face, although easily accessible, is curved. This applies, for example, to cylindrical outer surfaces of plungers and protective sleeves for shafts. For components having a planar sliding and sealing face, the use of scouring elements is not necessary.

Using the process according to the invention for ceramic objects, it is possible to obtain surfaces whose mean roughness Ra is between 0.1 and 0.8 μm, preferably 0.3–0.8 μm. If the components have a planar sliding and sealing face, an evenness of at least 0.3, preferably at least 0.6 μm and a maximum of 1.2 μm, preferably a maximum of 0.8 μm, can be produced. This applies, in particular, to aluminum oxide objects. In this case, the content of $Al_2O_3$ is not crucial. For example, ground aluminum oxide components whose $Al_2O_3$ content is greater than 80%, even better greater than 90%, in particular greater than 92%, preferably greater than 94%, can be employed. Components having a content of greater than 96%, greater than 98%, greater than 99% and greater than 99.5% by weight of $Al_2O_3$ can also be used. The higher the $Al_2O_3$ content, the better the strength values of the component. According to DIN 4762, the mean roughness Ra is known as the arithmetic mean roughness.

In the case of curved surfaces (for example cylinders, spheres and cones), the term evenness is replaced by the term surface accuracy, which indicates the maximum difference between the measured dimensions and the dimensions given by the mathematically defined shape of the article.

In scanning electron microscope photomicrographs, the surfaces produced by the process according to the invention exhibit a surface having rounded peaks. This surface has a considerably smaller number of sharp edges than a surface of the same mean roughness which has been produced by polishing (for example using diamond polishing paste). This is possibly due to the substantially lower working pressure during abrasive polishing.

Valve washers which have been produced by the process according to the invention require a displacement force which is up to 50% less than polished or lapped valve washers of the same composition. They are leakproof to liquid media in the range 0–20 bar. With respect to the sealing behavior against water, no differences can be determined compared to polished valve washers, at least up to a pressure of 6 bar.

Ceramic articles can be produced with reduced labor costs by the specified process. A further advantage is that, in simple apparatuses, a large number of units can be smoothed per unit time. It is surprising that hardly any of the brittle ceramic parts are damaged or destroyed during abrasive polishing. It is further proposed in German Patent 1,949,318, column 9, to lap valve washers made from aluminum oxide in order to provide them with an extremely smooth surface.

Abrasive-polished surfaces are less shiny than polished surfaces, but more than ground surfaces. They appear matt and do not reflect.

It has become apparent that it is even possible to obtain mean roughnesses (Ra) of 0.1 to 0.3 μm (and naturally greater) using the process according to the invention if the base material comprises at least 96%, in particular at least 98%, of $AL_2O_3$, and the mean crystallite size (in accordance with ASTME 112-74) of the aluminum oxide does not exceed a size of 8 microns. Similar values can be obtained for silicon carbide elements. Pure contents of greater than 99%, preferably greater than 99.5%, in particular at least 99.7%, by weight of $Al_2O_3$ are particularly favorable. It is favorable if the ceramic material used is free of pores. It is furthermore preferred if the mean crystallite size is in the range 2 to 6, in particular 3 to 5, μm. Surprisingly, aluminum oxide parts having an abrasive-polished sliding and sealing face require considerably lower displacement forces than identical parts of the same mean roughness whose sliding and sealing face has been produced by polishing.

The invention furthermore relates to an aluminum oxide sealing component for a machine which is free from $ZrO_2$ and $HfO_2$, the component being in frictional contact and having at least one planar sliding and sealing face, wherein the sliding and sealing face has a mean roughness (Ra) of greater than 0.1 and not more than 0.8 μm, as well as an evenness of 0.3–1.2 μm, and is nonreflective. The roughness is preferably 0.3–0.8 μm. The evenness of this sliding and sealing face is, in at least one measurement direction, in the range from at least 0.3, in particular at least 0.6, μm to a maximum of 1.2 μm, preferably a maximum of 0.8 μm. For example, steatite or silicon carbide components can be produced. Components based on aluminum oxide are preferred, in particular containing at least 80% by weight, preferably at least 90% by weight of $Al_2O_3$. Materials made from $Al_2O_3$ containing zirconium oxide and/or hafnium oxide are known from European Patent 043,456.

The shape of components according to the invention is not crucial. The only essential factor is the presence of a sliding and sealing face. It is intended that this machine part will later be in flat contact with another component. It should be possible for the two components to be moved mutually and the gap formed by them should be leakproof to fluids, such as, for example, water under pressure.

Preferably, the component according to the invention has the shape of a disk, of a cylinder or of a hollow cylinder.

The invention therefore relates also to a ceramic sealing component for a machine, the ceramic not having a content of $ZrO_2$ and $HfO_2$, the component being in frictional contact and having at least one sliding and sealing face, wherein the component has a cylindrical peripheral surface which is designed as a sliding and sealing face, a roughness (Ra) of greater than 0.1 and not more than 0.8 μm, as well as a surface accuracy of 0.3–1.2 μm, and is nonreflective.

In a refinement of this invention, the components have the shape of a cylindrical tube and can be used as piston skirts if the peripheral surface of the cylindrical tube is designed as a sliding and sealing face. The front faces of the tubes are preferably likewise designed as a sliding and sealing face. In a further embodiment, the component according to the invention has the shape of a hollow cylinder which is closed at one end, whose peripheral surface is designed as a sliding and sealing face. A component of this type can be employed, for example, as a plunger in high-pressure piston pumps. It is preferred if the front face of the hollow cylinder, in addition, is designed as a sliding and sealing face. In these cylindrical parts, the length : diameter ratio is preferably at least 1, in particular at least 2.

For valve washers, as installed in mixing valves or mixing faucets in the sanitary area for regulating liquid flows, a wide variety of ceramic washers are in use. In this case, at least one side of the washer has a sliding and sealing face. In the finished control elements, at least two such valve washers are in movable contact with one another, the sliding and sealing faces in each case being in sliding and sealing contact with one another. Diskshaped ceramic components having a sliding and sealing face are preferred, the thickness of the disk in most cases being 1–10 mm, in particular 2–5 mm. It is preferred if the $F^{0.5}$:D ratio in these disks is 3–12, in particular 5–9, where F is the surface area of a disk defined by the external dimensions, and D is the thickness of the disk. Disks having the ratio specified can be processed highly successfully in scouring vibrators. This applies, in particular, to disks of diameters 3–50 mm.

A valve washer for sanitary mixing faucets is frequently round or approximately round. It may have recesses on the periphery. In at least one washer of a control element, at least one channel for a liquid is provided. Usually, however, several channels are present for the liquids to be mixed and the mixed liquid. These channels connect the two sides of the valve washer. Valve washers having three openings are illustrated in German Patent 1,291,957. It is preferred if the sum of the cross-sections of the individual channels on each side is 5–45% of the washer surface area. If the proportion of the channel area is greater, the mechanical stability of the valve washers decreases. The counterpart to valve washers having channels are also valve washers having hollows arranged on the inside of the face.

It is preferred if the two sides of the valve washer are designed as an abrasive-polished sliding and sealing face.

In the case of valve cartridges, which contain two sealing washers in frictional contact with one another and a sealing O-ring on the rear of the movable washer, the danger of damage to the O-ring can be considerably reduced using washers which are smooth on both sides.

Suitable sliding rings in sliding ring gaskets are ceramic components in the form of a cylindrical ring washer. These rotationally symmetrical parts exhibit a rectangular outline on projection perpendicular to the axial direction. At least one, but preferably both ring-shaped sides of the washer are designed as a sliding and sealing face. The external diameter: washer thickness ratio is in most cases 2.6–15, in particular 3–11, preferably 3.5–9. It is also possible to produce angled rings, which can likewise be used as sliding elements in sliding ring gaskets, by the process according to the invention. These rotationally symmetric ceramic rings exhibit a T-shaped outline on projection perpendicular to the axial direction. The ring face having the larger surface area, in particular, is designed as the sliding face. The external diameter : thickness ratio is about 2–10. Preferred ranges for this ratio are 2.2 to 7, 2.8 to 5.6 and 3 to 5.

The invention is illustrated in greater detail by the example.

EXAMPLE

Aluminum oxide powder containing 96% by weight of $Al_2O_3$ is ground for 48 hours in the presence of water and grinding stones. With addition of 2% of a water-soluble binder, such as polyvinyl alcohol or methylcellulose, a slurry is prepared and sprayed. The granules obtained are transfer-red into a dye and shaped into a green element in a dry automatic press at a pressure of 15 kp/mm$^2$. Sintering takes place at 1700°–1750° C. The washers obtained are ground until level and plane-parallel.

The washers obtained are circular (diameter 17 mm) due to the shape of the die. They have 2 small lugs on the outer periphery and on the inside an approximately semi-crescent shaped channel on the inside. The area of the channel is about 25% of the entire washer surface area. The washers are 2.3 mm thick. About 40,000 units of such small water sealing washers are transferred into a scouring machine (William Boulton Ltd. Type FM3). The degree of filling is about 15% by volume. The machine is subsequently filled to the top with 70L of water. 1 g. of soft soap are added per liter of water. The speed of the motor is set to 1440 min$^{-1}$ and the unbalance to 15°. After abrasive polishing for 40 hours, the aqueous phase is removed and the contents are washed and dried. The surface of the abrasive-polished water-sealing washer has a roughness of 0.5–0.7 μm. The evenness of the sliding and sealing face of the sealing washer is 1–2 helium light bands (=0.3 to 0.6 μm.

We claim:

1. A process for the production of ceramic sealing components for a machine, the components being in frictional contact and having at least one planar or curved sliding and sealing face, comprising the steps of shaping green ceramic articles, sintering, grinding and subsequently smoothing the sliding and sealing faces formed, wherein the articles are smoothed by abrasion with each other in the presence of an aqueous phase, without using scouring elements, until a mean roughness of greater than 0.1 and not more than 0.8 μm is reached, the articles used being shaped in such a way that the sliding and sealing faces of the articles come in contact with the other articles during smoothing.

2. The process as claimed in claim 1, wherein the abrasive polishing takes place without prior washing of the ground ceramic articles.

3. A process for the production of a ceramic sealing component for a machine, the component being in frictional contact and having at least one planar or curved sliding and sealing face, comprising the steps of shaping a green ceramic article, sintering, grinding and subsequently smoothing the sliding and sealing face formed, wherein the article is smoothed in the presence of an aqueous phase containing scouring elements, but in the absence of finely divided abrasively acting substances until a mean roughness of greater than 0.1 and not more than 0.8 μm is reached, and wherein at least one surface of the article to be smoothed is in the interior of the article.

4. The process as claimed in claim 1, wherein the water contains organic additives having a surface activity.

5. The process as claimed in claim 1, wherein the articles are aluminum oxide ceramic articles.

6. The process as claimed in claim 1, wherein the apparatus used for smoothing is filled to the extent of 10 to 90% by volume with ceramic articles to be smoothed.

7. The process as claimed in claim 1, wherein the sliding and sealing faces of sliding rings or regulating washers are smoothed.

8. An aluminum oxide sealing component for a machine which is free from $ZrO_2$ and $HfO_2$, the component being in frictional contact and having at least one planar sliding and sealing face, wherein the sliding and sealing face has a mean roughness (Ra) of greater than 0.1 and not more than 0.8 μm, as well as an evenness of 0.3–1.2 pm, and is non-reflective.

9. A component as claimed in claim 8, wherein the evenness of the sliding and sealing face is in the range 0.3 to 0.8 μm.

10. A ceramic sealing component for a machine which does not contain $ZrO_2$ and $HfO_2$, the component being in frictional contact and having at least one sliding and sealing face, wherein the component has a cylindrical peripheral surface which is designed as a sliding and sealing face, a roughness (Ra) of greater than 0.1 and not more than 0.8 μm, as well as a surface accuracy of 0.3–1.2 μm, and is nonreflective.

11. A component as claimed in claim 10, form of a cylindrical tube whose peripheral surface is designed as a sliding and sealing face.

12. A component as claimed in claim 10, which has the shape of a hollow cylinder which is closed at one end and whose cylindrical surface is designed as a sliding and sealing face.

13. A component as claimed in claim 12, wherein the front face of the hollow cylinder, has a mean roughness (Ra) of greater than 0.1 and a maximum of 0.8 μm.

14. A component as claimed in claim 8, which has a disk shape and wherein at least one side of the disk has a sliding and sealing face.

15. A component as claimed in claim 14, wherein the disk has a thickness of 1 to 10 mm.

16. A component as claimed in claim 14, wherein the $F^{0.5}$:D ratio is 3 to 12, where F is the surface area of the disk, defined by the external dimensions of the disk, and D is the thickness of the disk.

17. A component as claimed in claim 14, wherein the two sides of the disk are connected by at least one channel.

18. A component as claimed in claim 17, wherein the sum of the cross-sections of the individual channels on each side is 5 to 45% of the disk surface area.

19. A component as claimed in claim 8, which has the shape of a short cylindrical tube, at least one ring-shaped front face being designed as a sliding and sealing face and the external diameter : tube thickness ratio being at least 2.6.

20. A component as claimed in claim 10, wherein the cylinder length : diameter ratio is at least 1.

21. A component as claimed in claim 8, which has an aluminum oxide content of greater than 80% by weight.

22. The process as claimed in claim 3, wherein the water contains organic additives having a surface activity.

23. The process as claimed in claim 3, wherein the articles are aluminum oxide ceramic articles.

24. The process as claimed in claim 3, wherein the apparatus used for abrasive polishing is filled to the extent of 10 to 90% by volume with ceramic articles to be smoothed.

25. The process as claimed in claim 3, wherein the sliding and sealing faces of sliding rings or regulating washers are smoothed.

26. A component as claimed in claim 14, wherein the $F^{0.5}$:D ratio is 5 to 9.

27. A process as claimed in claim 3, wherein the scouring elements are selected from the group consisting of spheres and rods of ceramic material.

28. A process as claimed in claim 27, wherein the scouring elements are selected from the group consisting of spheres having a diameter of 3 to 10 mm and rods having a length of 3 to 10 mm.

29. A process as claimed in claim 3, wherein the scouring elements range in size from 3 to 10 mm.

30. A process as claimed in claim 3, wherein the articles undergo tumbling movements during the smoothing step.

31. A process as claimed in claim 3, wherein the articles undergo short oscillating movements of high frequency during the smoothing step.

32. A process as claimed in claim 8, wherein the component has an aluminum oxide content of at least 96% and the aluminum oxide has a mean crystalline size which does not exceed 8 microns.

33. A process as claimed in claim 8, wherein the component has an aluminum oxide content of at least 98% and the aluminum oxide has a mean crystalline size which does not exceed 8 microns.

34. A process as claimed in claim 32, wherein the means surface roughness is between 0.1 to 0.3 microns.

35. A process as claimed in claim 27, wherein the scouring elements and the article to be smoothed are made of the same ceramic material.

* * * * *